US007066512B2

(12) United States Patent
Harris et al.

(10) Patent No.: US 7,066,512 B2
(45) Date of Patent: Jun. 27, 2006

(54) HOLE ENGAGING MULTIPLE BLOCK LIFTING DEVICE

(76) Inventors: Loren Harris, 17311 157th Ave. SE., Snohomish, WA (US) 98290; David Harris, 12327 Roosevelt Rd., Snohomish, WA (US) 98920; Brett Harris, 16301 107th Ave. NE., Bothell, WA (US) 98011

( * ) Notice: Subject to any disclaimer, the term of this patent is extended or adjusted under 35 U.S.C. 154(b) by 0 days.

(21) Appl. No.: 10/217,904

(22) Filed: Aug. 13, 2002

(65) Prior Publication Data

US 2003/0038493 A1 Feb. 27, 2003

Related U.S. Application Data

(60) Provisional application No. 60/313,888, filed on Aug. 21, 2001.

(51) Int. Cl.
*B66C 1/54* (2006.01)

(52) U.S. Cl. ..... 294/97; 294/63.1

(58) Field of Classification Search ..... 297/15, 297/16, 62, 63.1, 86.24, 93, 95, 97, 115
See application file for complete search history.

(56) References Cited

U.S. PATENT DOCUMENTS

| | | | | | |
|---|---|---|---|---|---|
| 806,672 | A | * | 12/1905 | Hunziker | 294/62 |
| 820,946 | A | * | 5/1906 | Balzer | 294/62 |
| 976,652 | A | * | 11/1910 | Hensley | 294/97 |
| 1,169,004 | A | * | 1/1916 | Cargin | 294/97 |
| 1,311,361 | A | * | 7/1919 | Vickers | 294/97 |
| 1,413,780 | A | * | 4/1922 | Rauch | 294/97 |
| 1,495,179 | A | * | 5/1924 | Hoffer | 294/16 |
| 1,734,360 | A | * | 11/1929 | Bittman | 294/97 |
| 2,370,482 | A | * | 2/1945 | Morgan et al. | 294/97 |
| 2,670,233 | A | * | 2/1954 | Barchoff | 294/97 |
| 2,718,426 | A | * | 12/1955 | Nagy | 294/87.1 |
| 2,823,948 | A | * | 2/1958 | Horton | 294/97 |
| 3,104,126 | A | * | 9/1963 | Lovash | 294/97 |
| 3,180,506 | A | * | 4/1965 | Moskopf et al. | 294/104 |
| 4,460,210 | A | * | 7/1984 | Miechur | 294/97 |
| 4,474,400 | A | | 10/1984 | Toffolon | 294/97 |
| 5,490,702 | A | | 2/1996 | Fleming | 294/97 |
| 5,704,675 | A | | 1/1998 | Reiley | 294/95 |
| 5,797,638 | A | | 8/1998 | Yamazaki et al. | 294/97 |
| 5,971,457 | A | * | 10/1999 | Gallo, Jr. | 294/97 |

* cited by examiner

FOREIGN PATENT DOCUMENTS

| | | | | |
|---|---|---|---|---|
| DE | 2431868 | * | 1/1976 | 294/62 |

*Primary Examiner*—Eileen D. Lillis
*Assistant Examiner*—Paul T. Chin
(74) *Attorney, Agent, or Firm*—Dean A. Craine

(57) ABSTRACT

A concrete block lifting device used to lift at least two blocks off a pallet for repositioning on a wall. The device includes a rigid, horizontal, support bar with a block gripping assembly attached thereto designed to selectively attach to blocks on a pallet and then securely engage the blocks when the device is lifted by the backhoe. The block gripping assembly includes a insert member perpendicularly aligned and extending downward from the support bar. Mounted pivotally on each insert member is an actuator arm. The upper end of the actuator arm is pivotally connected to a linking arm and a release handle. The upper ends of two linking arms converge and attach to a central plate. A cable connects the central plate to a bucket on a backhoe. When the central plate is lifted, the linking arms force the upper end of the actuator arms inward which forces the lower ends of the actuator arm outward to engage the inside wall of a central hole formed on the block.

6 Claims, 6 Drawing Sheets

HOLE ENGAGING MULTIPLE BLOCK LIFTING DEVICE

This is a utility patent application based on a provisional patent application (Ser. No. 60/313,888) filed on Aug. 21, 2001.

BACKGROUND OF THE INVENTION

1. Field of the Invention

This invention pertains to devices used to lift concrete building or retaining wall blocks into position on a wall and, more particularly, to such devices that lift the blocks directly from their pallets for positioning on the wall.

2. Description of the Related Art

Lifting devices that are used with backhoes to help construction workers more efficiently set heavy concrete blocks in place on building or retaining walls are widely known. These devices eliminate the need for workers to individually lift and position the concrete blocks, consequently saving time, physical energy, and labor cost. Unfortunately, such devices only lift and position one concrete block at a time, which makes wall building a slow, tedious process.

Retaining wall blocks are shipped from the manufacturer in a specific alignment on pallets. Typically, the blocks are stacked in layers five to six blocks high, with four to nine blocks in each layer, being arranged in two rows with the blocks in each row turned in opposite directions. Because each block typically weighs approximately 65–120 lbs, it is desirable to use a backhoe to individually lift each block from the pallet to different elevations on the wall.

In order to expedite the process and reduce labor and equipment costs, a simple, inexpensive lifting device used in conjunction with a backhoe is needed that can easily and securely lift two or more concrete blocks in their original orientation directly off the shipment pallet for placement on the wall. Also needed is such a lifting device that includes means to manually grab and release the blocks.

SUMMARY OF THE INVENTION

It is an object of the present invention to provide a concrete block lifting device capable of lifting at least two blocks using a backhoe or similar equipment.

It is another object of the invention to provide such a device that is designed to lift the blocks from its original orientation directly from the shipping pallet and align the blocks for immediate placement on a wall.

It is a further object of the present invention to provide such a device that can be easily placed on the blocks while on the shipping pallet and then automatically and securely engage the blocks when a lifting force is applied to the device.

It is another object of the invention to provide such a method of placing blocks originally located on a pallet directly onto a wall.

These and other objects of the invention that will become apparent are met by a concrete block lifting device used to lift at least two blocks off a pallet for direct and accurate repositioning on a wall. The device includes a rigid, horizontally aligned, support bar with at least two automatically engaging block gripping means, spaced apart and attached to the support bar. Both block gripping means automatically attach to the center holes on two adjacent blocks positioned on a pallet when an upward force is applied to the support bar by a lift cable. Coupled to each block gripping means is a release lever that the worker selectively operates to release the block gripping means from the blocks when the blocks are positioned in a desired location on the wall and the upward force is reduced or removed entirely.

In the preferred embodiment, each block gripping means includes a vertical insert member that fits into the center hole formed in a block. Pivotally mounted on each insert member is an actuator arm that moves between disengaged and engaged positions against the inside wall of the center hole of each block. The upper end of each actuator arm is pivotally connected to the lower end of a linking arm that extends diagonally downward from a central lifting member located above and centrally over the support arm. When the device is properly aligned on two blocks, the lower ends of the actuator arms are disposed inside the center holes of the blocks.

When the central lifting member is lifted by a cable attached to a crane or to a bucket on a backhoe, the upper ends of the two linking arms are raised, thereby pulling the upper ends of the actuator arms inward. Simultaneously, the lower ends of the actuator arms are forced outward, pressing forcibly against the inside walls of the center holes so that the device securely engages two or more blocks.

The blocks are then lifted to the desired location on the wall and slowly lowered onto the top layer of blocks on the wall. When the blocks are resting on the top layer of blocks, tension applied by the cable to the linking arms and to the actuator arms is reduced so that the worker may lightly tap the release levers thereby causing the lower ends of the activator arms to disengage from the blocks. While holding the release levers inward to keep the activator arms in a disengaged position, the device is then lifted from the blocks and returned to the pallet to pick up two more blocks.

DESCRIPTION OF THE PREFERRED EMBODIMENT(S)

Figure 1:
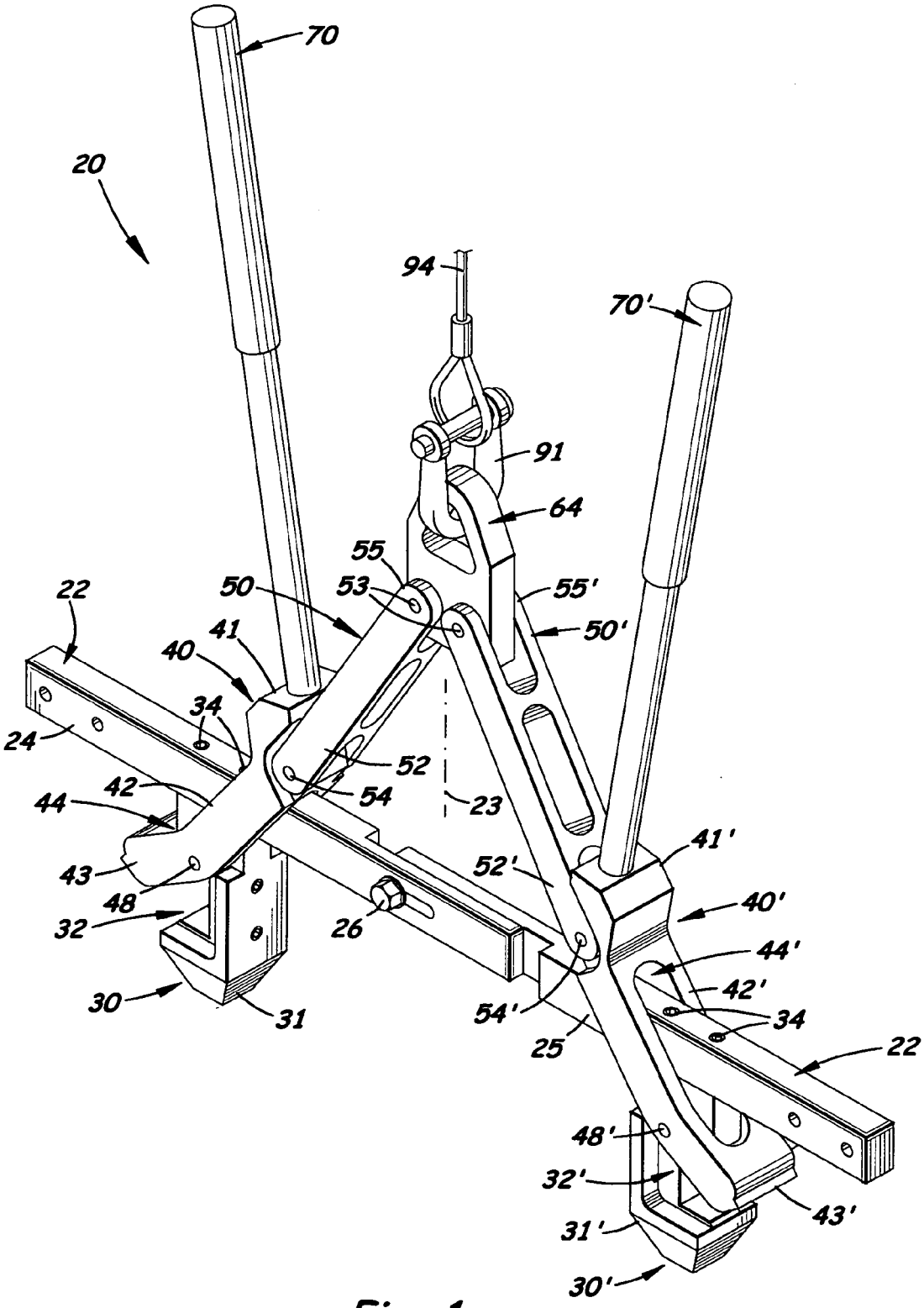
FIG. 1 is a perspective view of the multiple block lifting device disclosed herein.
Figure 2:
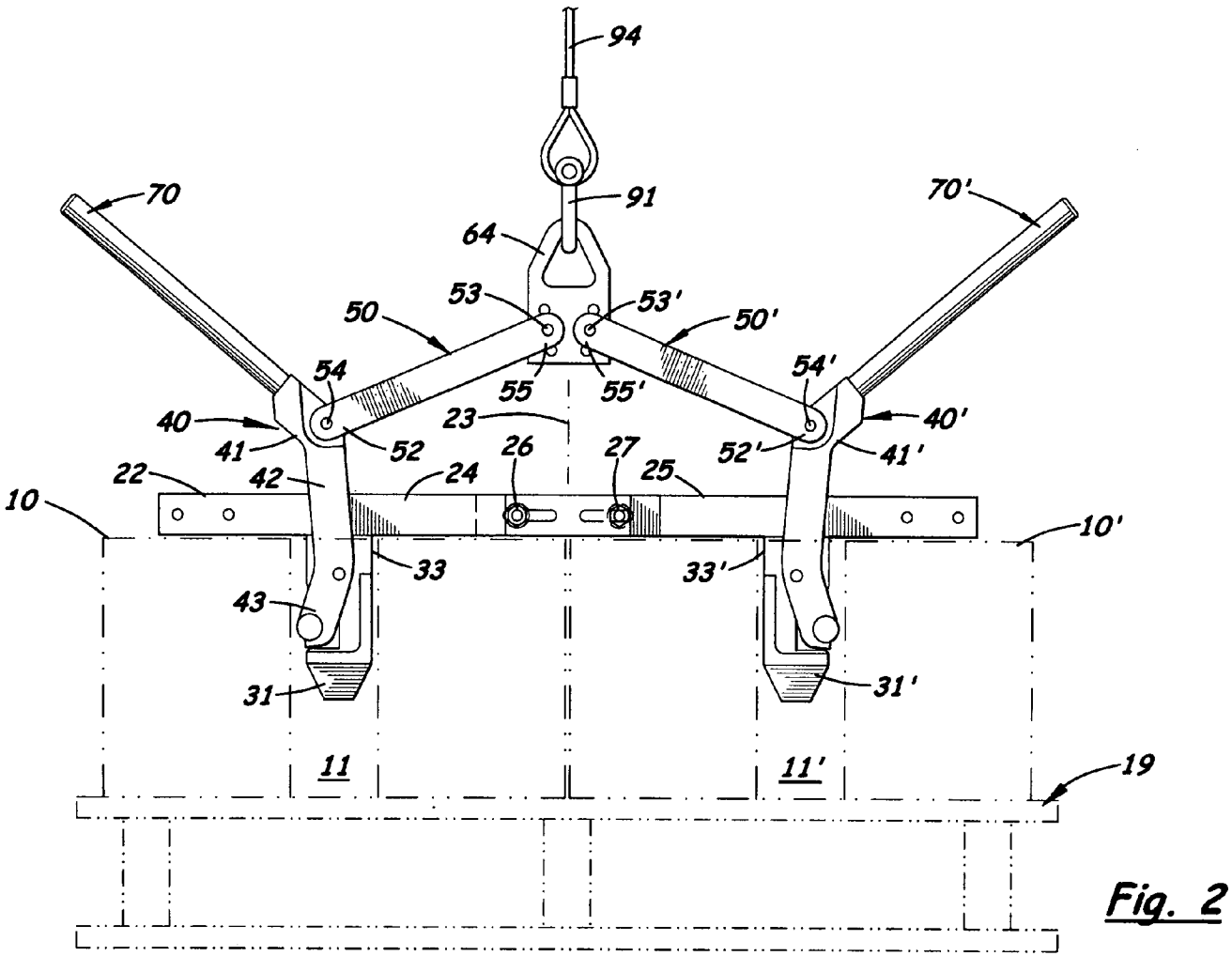
FIG. 2 is a front elevational view of the device shown being positioned over two blocks located on a pallet.
Figure 3:
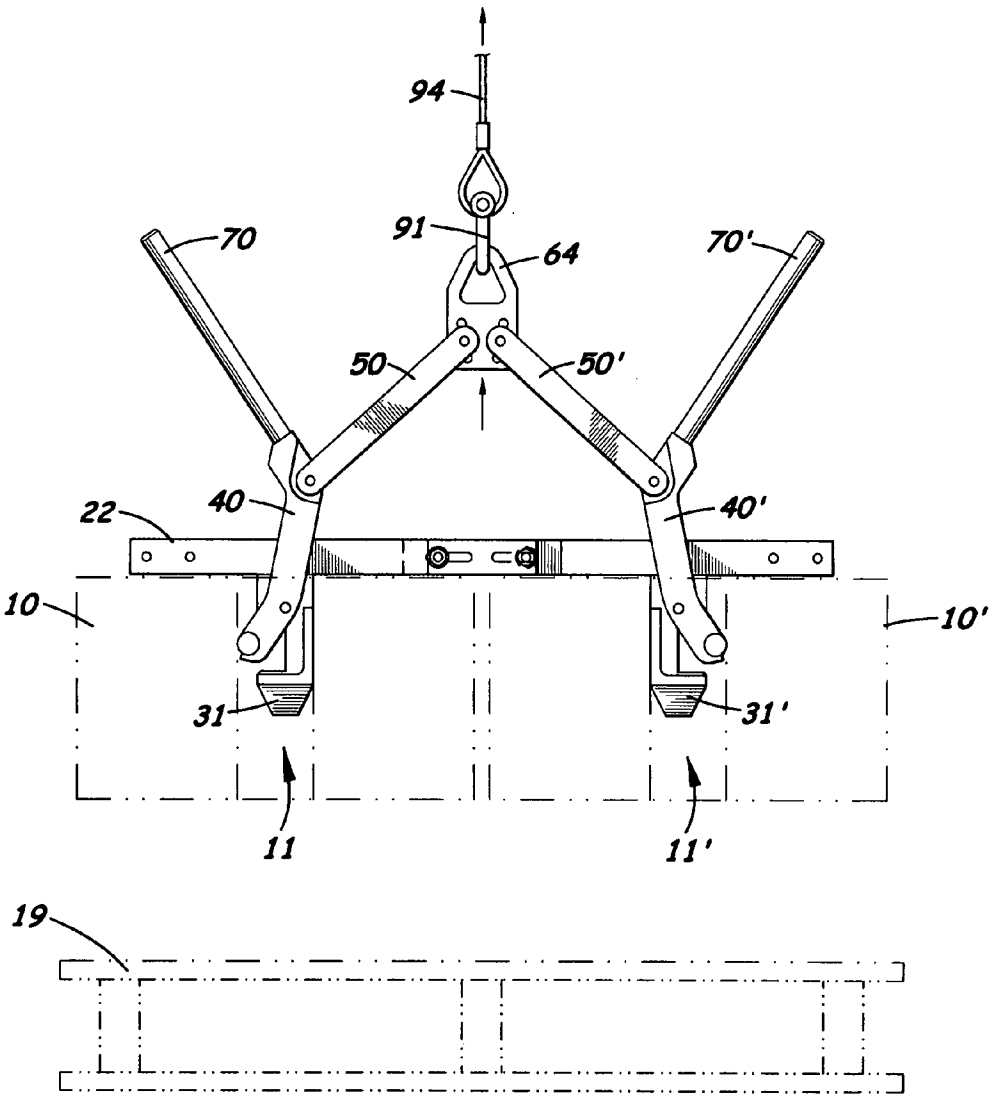
FIG. 3 is a front elevational view of the device being used to lift two blocks off a pallet.
Figure 4:
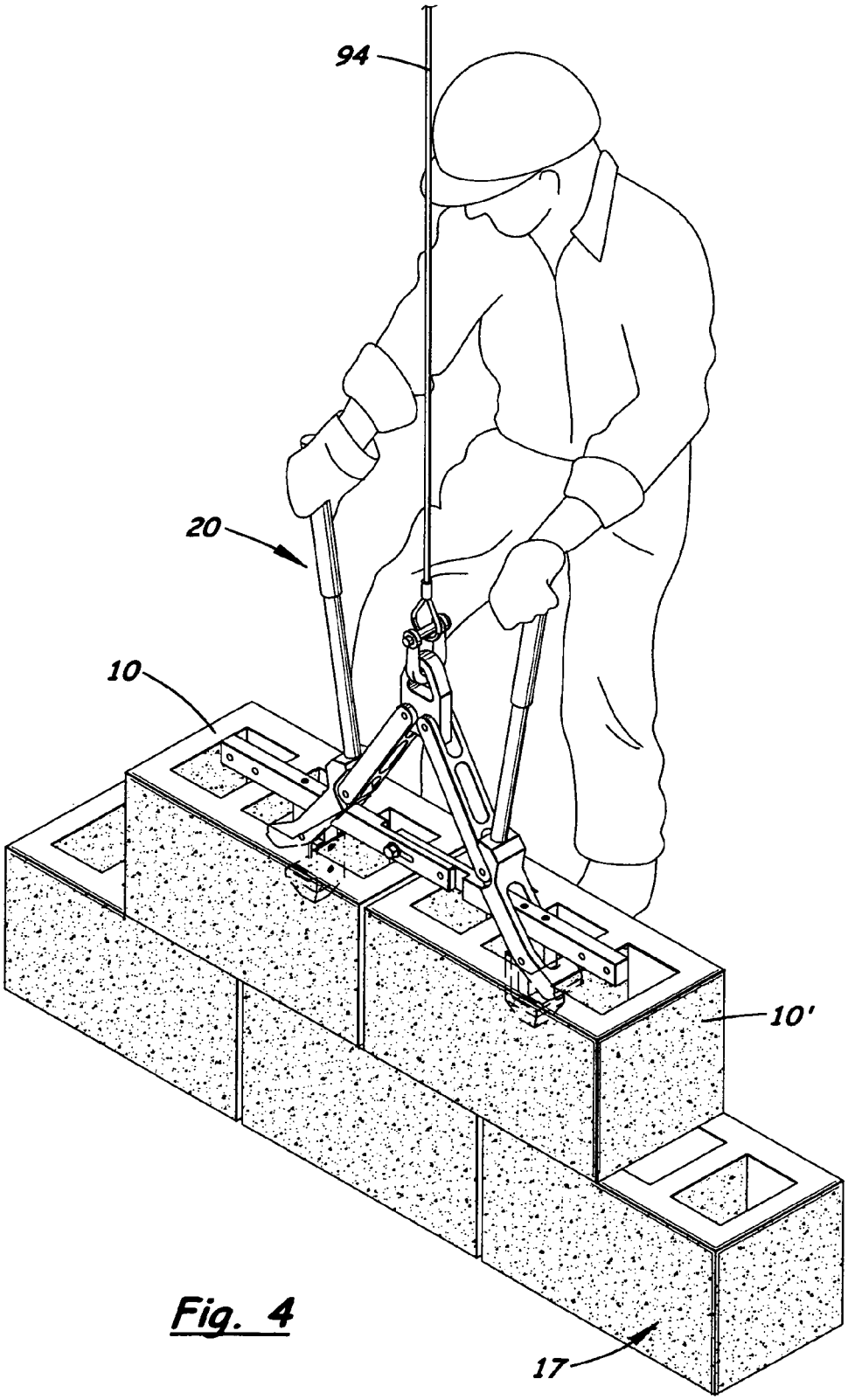
FIG. 4 is a perspective view of a worker using the multiple block lifting device to position two blocks on a retaining wall.
Figure 5:
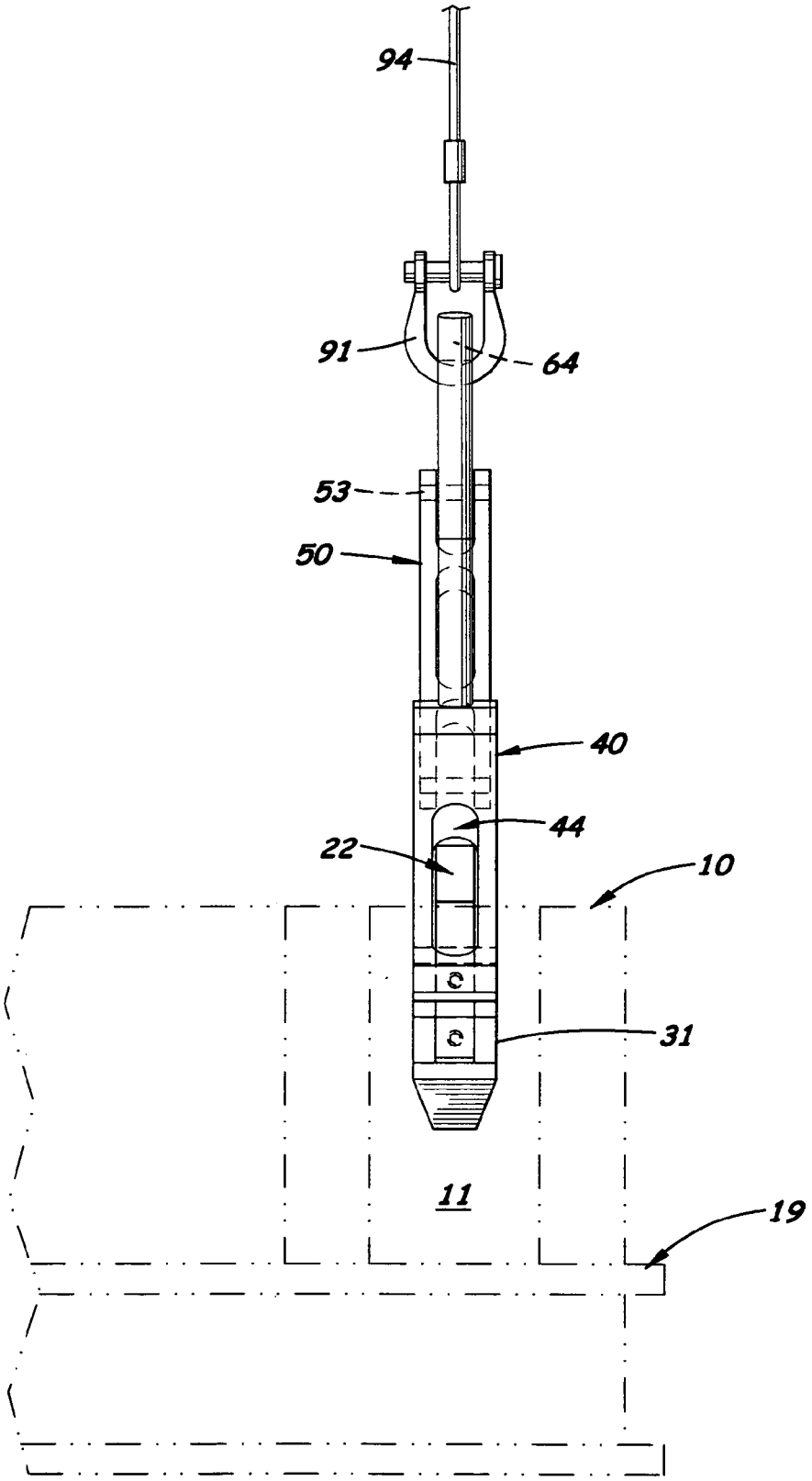
FIG. 5 is a left side elevational view of the device shown in FIG. 3.

Referring to the accompanying Figs., there is shown and described a concrete block lifting device 20 used to lift two blocks 10, 10' off a pallet 19 for repositioning on a wall 17. The device 20 includes a rigid support bar 22 with at least two vertically aligned, block gripping means 30, 30' designed to automatically engage two adjacent blocks 10, 10' positioned on a pallet 19 when an upward force is applied by a cable 94 which is attached to lifting equipment (not shown).

The device 20 includes a rigid, horizontally aligned, support bar 22. In the preferred embodiment, there are two block gripping means 30, 30' attached to the rigid support bar 22. The two block gripping means 30, 30' are sufficiently spaced apart along the support bar 22 for attachment to two adjacent blocks 10, 10' in their original locations when shipped on the pallet 19. The two shorter sections 24, 25 act as a length adjustment means that allow the user to adjust the spacing between the two block gripping means 30, 30' for use with different size blocks. It should be understood that the device 20 could be manufactured with three or more blocking gripping means. The two shorter sections 24, 25 are longitudinally aligned and connected together at their ends by two suitable threaded connectors 26, 27.

Each block gripping means 30, 30' includes a vertical insert member 31, 31' that fits into the center hole 11, 11' formed in a retaining wall block 10, 10'. In the preferred embodiment, each insert member 31, 31' has an L-shaped cutout 32, 32' formed on its lateral surface. The upper end 33, 33' of each insert member 31, 31' is attached to the bottom surface of the support bar 22 by threaded connectors 34, 35, respectively.

Disposed over the upper end 33, 33' of the insert member 31, 31' and the outer section of the support bar 22 is a pivoting actuator arm 40, 40'. In the preferred embodiment, each actuator arm 40, 40' is bowl shaped with an upper end 41, 41', an intermediate section 42, 42', and a lower end 43, 43'. Formed in the intermediate section 42, 42' is a passageway 44, 44' through which the outer section of the support bar 22 extends. The lower end 43, 43' is pivotally connected to the upper end 33, 33' of the insert members 31, 31'. A bolt 48, 48' extends transversely through the insert members 31, 31' and the actuator arms 40, 40', respectively, to pivotally connect them together.

The upper end 41, 41' of each actuator arm 40, 40' extends upward and above the support bar 22 and is pivotally connected to the lower end 52, 52' of a linking arm 50, 50' by a bolt 54. Each linking arm 50, 50' is substantially straight and pivotally attached to a center plate 64 via bolts 53, 53'.

Figure 6:
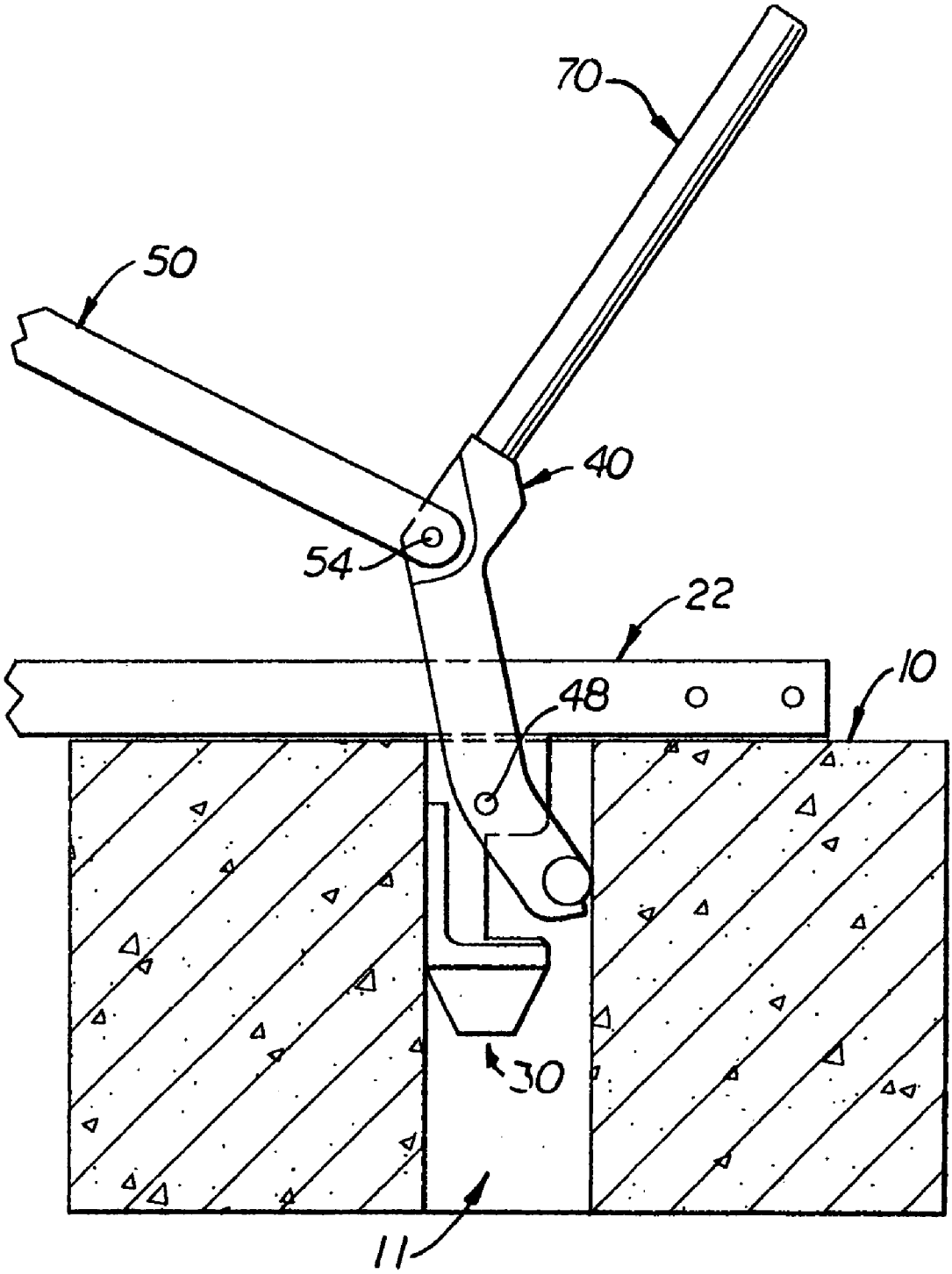
FIG. 6 is a partial front elevational view of the device showing the movement of the actuator arm to lift a block.

The linking arms 50, 50' from adjacent actuator arms 40, 40' are longitudinally aligned over the support bar 22 and converge towards the support bar normal axis 23. Located along the normal axis 23 and above the support bar 22 is a center plate 64 to which the upper ends 55, 55' of the two linking arms 50, 50', respectively, are pivotally attached. Attached to the center plate 64 is a shackle 91 to which a cable 94 connects to a bucket on a backhoe (not shown) used to lift the device 20. Two bolts 53, 53' extend through the upper ends 55, 55' of the two linking arms 50, 50', respectively, to pivotally connect the linking arms 50, 50' to the center plate 64. When the center plate 64 is lifted, the upper ends 55, 55' on each linking arm 50, 50' are aligned diagonally over the support bar 22 approximately 45 degrees. When the linking arms 50, 50' are pulled upward, the upper ends 41, 41' of the actuator arms 40, 40', respectively, are pulled upward and inward and diagonally aligned over the support bar 22 to approximately 60 degrees. Simultaneously, the lower ends 43, 43' of the actuator arms 40, 40', respectively, located adjacent to the insert members 31, 31' are forced upward and outward through passageways 44, 44' formed on the insert members 31, 31', as shown in FIG. 6, thereby engaging the side of the center hole 11, 11' on the blocks 10, 10', respectively.

In the preferred embodiment, two release levers 70, 70' are connected to the upper ends 41, 41' of the actuator arms 40, 40' and extend longitudinally and diagonally outward over the ends of the support bar 22. When the two actuator arms 40, 40' are positioned to engage the center holes 11, 11', the release levers 70, 70' are manually forced downward by the user which moves the lower ends 43, 43' of the actuator arms 40, 40' inward and inside the L-shape cutout 32, 32' to a disengaged position. When the device 20 is used to lift blocks 10, 10', the release levers 70, 70' are released thereby allowing the actuator arms 40, 40' to automatically move to an engaging position.

The rigid support bar 22 is made of square or rectangular steel tubing material approximately 24 to 48 inches in length. The insert members 31, 31' are made of square or rectangular tubing measuring approximately 1½ inches in *width*, 1½ inches in *height*, and 9 inches in length. The insert members 31, 31' are approximately 12 to 24 inches apart along the support bar 22. The linking arms 50, 50' are also made of steel tubing material and measure approximately 2½ inches in *width*, 1¼ inches in *height*, and 12 inches in length. The actuator arms 40, 40' are made of flat steel bar material and measure approximately 2½ inches in width, 1¼ inches in *thickness*, and 12 inches in length. The release levers 70, 70' are made of round steel tubing material and measure approximately 1½ inches in *width*, 1½ inches in *height*, and 12 inches in length. Passageways 44, 44' are an elongated oval shape and measure approximately 1¾ inches in width and 6 inches in length.

Using the above-described device 20, a method of placing blocks 10, 10', with center holes 11, 11' vertically aligned, facing the same direction, and side-by-side on a pallet 19, directly onto a wall 17 is also provided. The method includes the following steps:

a. selecting a multiple block lifting device 20 including a support bar 22, at least two block gripping means 30, 30' spaced apart and pivotally attached to said support bar 22, the block gripping means 30, 30' being able to be fit into the center hole 11 formed on the blocks 10, 10'; each block gripping means 30, 30' including an insert member 31, 31' which is perpendicularly aligned and extending downward from the support bar 22 and which is able to fit into a vertically aligned center hole 11 formed on a block 10, 10'; an actuator arm 40, 40' extending above the support bar 22 and pivotally attached at one end to the insert member 31, 31' and at an opposite end to a linking arm 50, 50'; a release lever 70, 70' coupled to each block gripping means 30, 30'; a center plate 64 selectively connected to a lifting cable 94; and a linking arm 50, 50' disposed between the center plate 64 and each block gripping means 30, 30', whereby when the block gripping means 30, 30' is inserted into the center hole 11 and the center plate 64 is lifted, the linking arm 50, 50' is used to engage and disengage the block gripping means 30, 30' from a block 10, 10' to connect and disconnect the device;

b. attaching the cable 94 to lifting equipment (not shown);

c. positioning the insert members 31, 31' over the center holes 11, 11' on two adjacent blocks 10, 10';

d. lowering the device 20 until the insert members 31, 31' and the lower ends 43, 43' of the actuator arms 40, 40' are extended into the center holes 11, 11';

e. lifting the device 20 so that the actuator arms 40, 40' are forced outward to engage the inside surface of the center holes 11, 11';

f. positioning the blocks 10, 10' over a desired location on a wall 17; and, g. lowering the blocks 10, 10' so that said actuator arms 40, 40' may be moved inward and disengaged from the blocks 10, 10'.

In compliance with the statute, the invention described herein has been described in language more or less specific as to structural features. It should be understood, however, that the invention is not limited to the specific features shown, since the means and construction shown is comprised only of the preferred embodiments for putting the invention into effect. The invention is therefore claimed in any of its forms or modifications within the legitimate and valid scope of the amended claims, appropriately interpreted in accordance with the doctrine of equivalents.

We claim:

1. A multiple block lifting device for lifting blocks having a main hole formed therein, said device comprising:

a. a support bar;

b. at least two block gripping means spaced apart and attached to said support bar, each said block gripping means including an insert member attached and perpendicularly aligned and extending downward from said support bar, and an actuator arm pivotally attached to said insert member, said actuator arm including an upper portion that extends above and a lower portion that extends below said support bar, said insert member and said lower portion of said actuator arm when rotated inward able to fit into a main hole formed on a block;

c. a center plate selectively connected to a lifting cable; and, d. two linking arms each pivotally attached at one end to said center plate and pivotally attached at an opposite end to one said actuator arm, whereby when said insert member and said lower portion of said actuator arm are inserted into the main hole on a block and said center plate is lifted, said lower portion of each said actuator arm rotates outward on said linking arm to engage the inside surface of the main hole to connect said device to a block.

2. The multiple block lifting device, as recited in claim 1, wherein said support bar is made of two longitudinally aligned short bar sections connected together to adjust the overall length of said support bar.

3. The multiple block lifting device, as recited in claim 1, wherein each said actuator arm includes a passageway formed therein through which an outer section of said support bar may extend.

4. The multiple block lifting device, as recited in claim 1, further including a release handle attached to each said actuator arm to forcibly move each said actuator arm to disengage the inside surface of the block when said insert member and said actuator arm are inserted into the main hole formed on the block.

5. The multiple block lifting device, as recited in claim 1, further including a shackle used to connect said cable to said center plate.

6. A method for lifting blocks with center holes, aligned side-by-side and facing the same direction on a pallet, comprising the following steps:

a. selecting a multiple block lifting device including a support bar at least two insert members spaced apart and perpendicularly aligned and extending downward from said support bar, each said insert member being able to fit into a main hole formed on a block, said device also including an actuator arm pivotally attached to each said insert member, each said actuator arm including an upper portion extending above said support bar and a lower portion that extends below said support bar, a center plate selectively connected to a lifting cable, and a linking arm disposed between said center plate and each said actuator arm, whereby when said insert members and said lower portions of said actuator arms are inserted into the main holes on two adjacent blocks and said center plate is lifted, said linking arms pull said upper portions of said actuator arms inward and force said lower portions outward to engage the inside surfaces of the main holes to connect said blocks to said device;

a. attaching said cable to a lifting equipment;

c. positioning said support bar so that said insert members may be inserted into the main holes in two adjacent said blocks;

d. lowering said support bar until said insert members are fully extended into the main holes;

e. lifting said support bar so that said lower portions of said actuator arms are forced outward and against the inside surfaces of the main holes to engage said blocks;

f. moving said support bar to position said blocks over a desired location; and, g. lowering said support bar until the outward forces exerted by said lower portions of said actuator arms against the inside surfaces of the main holes are reduced so that said device may be released from said blocks.

* * * * *